US006666677B1

(12) United States Patent
Ichikawa et al.

(10) Patent No.: US 6,666,677 B1
(45) Date of Patent: Dec. 23, 2003

(54) PIEZOELECTRIC GAS LIGHTER

(75) Inventors: Toshihiro Ichikawa, Oyama-cho (JP); Masaki Saito, Oyama-cho (JP)

(73) Assignee: Tokai Corporation, Tokyo (JP)

( * ) Notice: Subject to any disclaimer, the term of this patent is extended or adjusted under 35 U.S.C. 154(b) by 270 days.

(21) Appl. No.: 09/711,817

(22) Filed: Nov. 13, 2000

(30) Foreign Application Priority Data

Nov. 15, 1999 (JP) ..... 11-323770

(51) Int. Cl.[7] ..... F23Q 2/28
(52) U.S. Cl. ..... 431/153; 431/255
(58) Field of Search ..... 431/153, 255

(56) References Cited

U.S. PATENT DOCUMENTS

| | | | | |
|---|---|---|---|---|
| 5,145,358 A | | 9/1992 | Shike et al. | |
| 5,427,522 A | * | 6/1995 | McDonough et al. | 222/153.13 |
| 5,435,719 A | * | 7/1995 | McDonough et al. | 222/153.14 |
| 5,833,448 A | | 11/1998 | Doucet et al. | |
| 5,839,892 A | * | 11/1998 | Hwang | 431/153 |
| 5,885,069 A | | 3/1999 | Rogelet | |
| 6,146,129 A | * | 11/2000 | Li | 431/153 |
| 6,382,960 B1 | * | 5/2002 | Frigiere et al. | 431/153 |

FOREIGN PATENT DOCUMENTS

| | | | |
|---|---|---|---|
| EP | 0 345 729 | * 12/1989 | 431/153 |

* cited by examiner

*Primary Examiner*—Carl D. Price
(74) *Attorney, Agent, or Firm*—Baker Botts L.L.P.

(57) ABSTRACT

A piezoelectric gas lighter includes a lighter body. The fuel gas in the lighter body is supplied to a nozzle through a valve mechanism which is opened and closed by an actuator lever and a piezoelectric unit ignites the fuel gas discharged from the nozzle. A depression member actuates the actuator lever and the piezoelectric unit to open the valve mechanism and ignite the fuel gas discharged from the nozzle in response to depression of the depression controller. The depression member includes a control cap operatively connected to a piezoelectric unit, a stopper member which is movable between a locking position where the control cap is prevented from being depressed and a releasing position where the control cap is permitted to be depressed and an urging member which urges the stopper member to the locking position. The stopper member is provided with a pair of sliding portions extending back and forth on opposite sides of the control cap and the sliding portions are slidably supported by the control cap so that the stopper member is movable downward together with the control cap and movable between the locking position and the releasing position. The urging member includes a pair of resilient pieces provided on opposite sides of the control cap so that they are engaged with the sliding portions of the stopper member to urge the stopper member to the locking position and the stopper member is moved to the releasing position by urging the stopper member toward the control cap.

6 Claims, 10 Drawing Sheets

PIEZOELECTRIC GAS LIGHTER

BACKGROUND OF THE INVENTION

1. Field of the Invention

This invention relates to a piezoelectric gas lighter in which the fuel gas is discharged and ignited in response to depression of a depression means, and more particularly to a structure for improving controllability and stability of action of a lock mechanism for disabling the depression means from being depressed in the piezoelectric gas lighter.

2. Description of the Related Art

In a piezoelectric gas lighter in which a valve mechanism and a piezoelectric unit are actuated in response to depression of a depression means (a control cap) so that fuel gas discharged from a gas discharge nozzle is ignited by a spark generated by the piezoelectric unit, there have been known various lock mechanisms which disable the depression means from being depressed to lock the lighter when it is not used and enable the depression means to be depressed in response to a lock release action when the lighter is to be used.

For example, U.S. Pat. No. 5,145,358 (will be referred to as "the first prior art", hereinbelow) discloses a lock mechanism in which a control cap is provided with a stopper member which is movable between its locking position where it prevents depression of the control cap and its releasing position where it permits depression of the control cap and is urged to the locking position, the stopper member being moved from the locking position to the releasing position by sliding an upper end portion thereof.

U.S. Pat. No. 5,885,069 (will be referred to as "the second prior art", hereinbelow) discloses a lock mechanism in which the whole control cap is movable about a piezoelectric unit between the locking position and the releasing position and a resilient portion for urging the control cap to the locking position is provided integrally with the control cap.

Further, U.S. Pat. No. 5,833,448 (will be referred to as "the third prior art", hereinbelow) discloses a lock mechanism in which a piezoelectric unit/control cap assembly is arranged to be rotatable between the locking position and the releasing position and the assembly is urged to the locking position by a separate resilient member.

However, the gas lighters provided with the lock mechanism in accordance with the first to third prior arts are disadvantageous in that the part for releasing the lock mechanism is small and hard to handle, the action of the lock mechanism is instable, or the control cap is moved to a direction different from the direction of depression of the control cap in response to the action of the lock mechanism, which makes it instable the ignition action, and that changes in components from the conventional volume products and incorporation of the components is complicated, which adds to the manufacturing cost of the lighters.

Specifically, in the lighter provided with the lock mechanism in accordance with the first prior art, since a lock member having a small control portion is provided to be slidable on a part of the surface of the control cap and the lock member is controlled, the lock releasing action is difficult and the normal ignition action is hard. Further, since a coiled spring for urging the lock member is disposed above the piezoelectric unit in the control cap, the position of the piezoelectric unit is changed from that in the conventional lighter without a lock mechanism, which results in many components to be changed and complicates incorporation of the spring.

In the lighter provided with the lock mechanism in accordance with the second prior art, since the whole control cap is moved about a piezoelectric unit between the locking position and the releasing position, depression of the control cap is apt to be instable and the engagement between the piezoelectric unit and the control cap becomes instable which weaken the integrality of the assembly.

In the lighter provided with the lock mechanism in accordance with the third prior art, since lock of the lighter is released by inclining the piezoelectric unit/control cap assembly, the position of the piezoelectric unit becomes assembly and the distance between the piezoelectric and the nozzle across which the spark is generated varies from ignition action to action, which deteriorates the igniting performance. Further, the structure exposes the gap between the control cap and the lighter body and permits foreign matters to enter the lighter body to obstruct the igniting action and the quenching action.

SUMMARY OF THE INVENTION

In view of the foregoing observations and description, the primary object of the present invention is to provide a piezoelectric gas lighter which can be manufactured at low cost without deteriorating the controllability of the lock mechanism, the stability in action and the igniting performance and with a less number of components to be changed from the conventional components.

In accordance with the present invention, there is provided a piezoelectric gas lighter comprising a lighter body in which fuel gas is stored, a fuel supply means which supplies the fuel gas in the lighter body to a nozzle through a valve mechanism, an actuator lever for opening and closing the valve mechanism, a spark ignition means which ignites the fuel gas discharged from the nozzle, and a depression means which actuates the actuator lever and the spark ignition means to open the valve mechanism and ignite the fuel gas discharged from the nozzle in response to depression of the depression means, wherein the improvement comprises that the depression means comprises a control cap operatively connected to a piezoelectric unit, a stopper member which is movable between a locking position where a part of the stopper member is engaged with the lighter body to disable the control cap from being depressed and a releasing position where the stopper member is released from the lighter body to permit depression of the control cap and an urging member which urges the stopper member to the locking position, the stopper member is provided with a pair of sliding portions extending back and forth on opposite sides of the control cap and the sliding portions are slidably supported by the control cap so that the stopper member is movable downward together with the control cap and movable between the locking position and the releasing position, and the urging member comprises a pair of resilient pieces provided on opposite sides of the control cap so that they are engaged with the sliding portions of the stopper member to urge the stopper member in the locking position and the stopper member is moved from the locking position to the releasing position by urging the stopper member toward the control cap.

The urging member may be formed of a pair of resilient pieces of resin formed integrally with the control cap or may be formed of a pair of resilient pieces of resin or metal formed separately from the control cap.

The stopper member may comprise a peripheral wall which covers the opposite side surfaces and the rear surface of the control cap. Preferably, the stopper member is provided with a control portion which covers the upper surface of the control cap at least at a rear portion of the control cap.

Preferably, the control cap is provided with a hook portion which is engaged with a projection, which projects inward from the sliding portions of the stopper member, to limit the movement of the stopper member to the locking position.

In the gas lighter in accordance with the present invention, since the depression means is formed by a control cap, a stopper member and an urging member and the stopper member is provided with a pair of sliding portions which extend back and forth on opposite sides of the control cap and are slidably supported by the control cap so that the stopper member is movable downward together with the control cap and movable between the locking position and the releasing position, a part of the stopper member is in engagement with the lighter body to prevent depression of the control cap, thereby locking the lighter from being ignited, in the normal state where the stopper member is in the locking position, and when the stopper member is moved to the releasing position, the stopper member is disengaged from the lighter body to permit depression of the control cap.

After the gas lighter is ignited and the depression means is released, the depression means moves upward and at the same time, the stopper member is automatically moved to the locking position under the urging force of the urging member, thereby locking the lighter from being ignited.

Further, since the stopper member is separated from the control cap and the stopper member is moved relative to the control cap by virtue of the sliding portions and the resilient pieces, the lighter can be locked and released by a simple action of sliding the sliding portions back and forth relative to the nozzle, the locking action and the releasing action can be stabilized and the controllability of the lighter is improved. Further, by only changing the control cap of the conventional piezoelectric gas lighter without a lock mechanism, a piezoelectric gas lighter provided with a lock mechanism can be realized. That is, the lock mechanism can be incorporated in the conventional piezoelectric gas lighter without a lock mechanism without changing the relative positions between the components, such as the relative position between the piezoelectric unit and the nozzle, the manner of fixing the piezoelectric unit and the control cap and the movement of the piezoelectric. At the same time, the control cap is held stationery when the stopper member is moved between the locking position and the releasing position, and the piezoelectric unit and the control cap can be fixed together by fitting. Further, the control cap can be held by a windshield cap not to be drawn out in the vertical direction. Thus, a piezoelectric gas lighter with a lock mechanism which is stabilized in its igniting performance and igniting action can be manufactured at low cost.

Further, by disposing the resilient pieces on opposite sides of the control cap to be engaged with the stopper member and urge the same to the locking position, the lock mechanism can be incorporated without changing the relative position between the control cap and the piezoelectric unit, and the stopper member can be stably moved and urged to the locking position. Further, since the stopper member is moved from the locking position to the releasing position by urging the stopper member toward the control cap, lock releasing and ignition can be effected in a series of actions, which further improves controllability of the lighter. Especially when the urging member is formed by a pair of resilient pieces of resin formed integrally with the control cap or formed by a pair of resilient pieces of resin or metal formed separately from the control cap, incorporation of the depression means is facilitated and the manufacturing cost can be reduced.

When the stopper member is provided with a peripheral wall which covers the opposite side surfaces and the rear surface of the control cap, the stopper member is further stably moved between the locking position and the releasing position. When the stopper member is provided with a control portion which covers the upper surface of the control cap at least at a rear portion of the control cap, the area for operating the stopper member is enlarged and the operation of the stopper member is facilitated.

DESCRIPTION OF THE PREFERRED EMBODIMENTS

Figure 1:
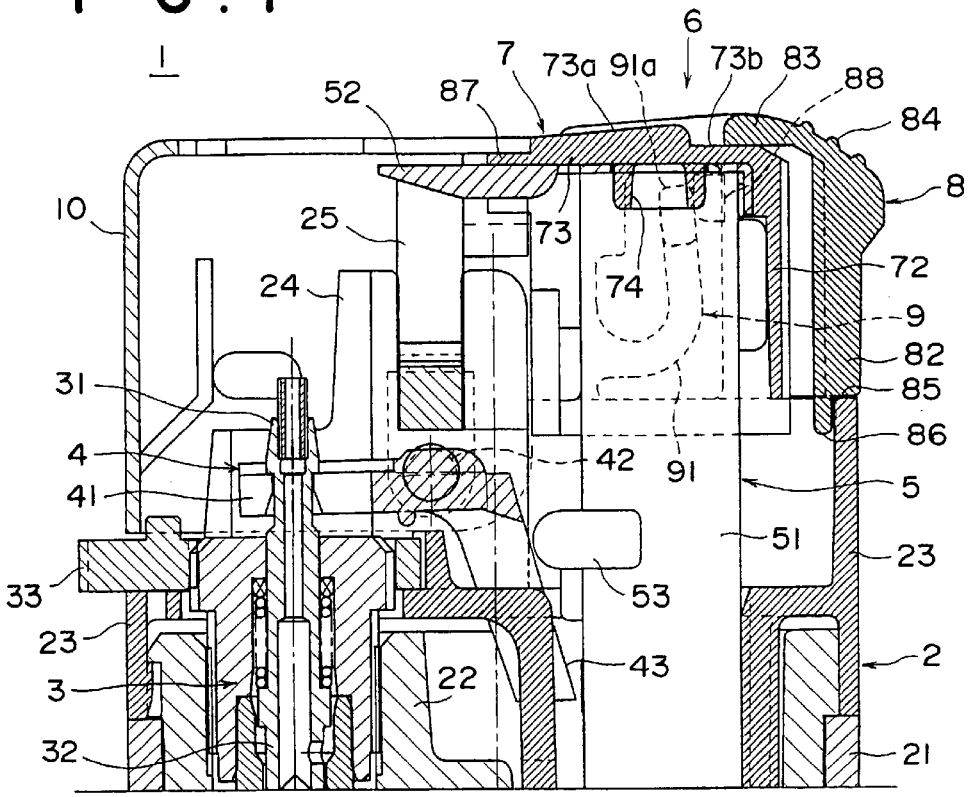
FIG. 1 is a fragmentary cross-sectional view of a piezoelectric gas lighter in accordance with a first embodiment of the present invention in a locked state.
Figure 2:
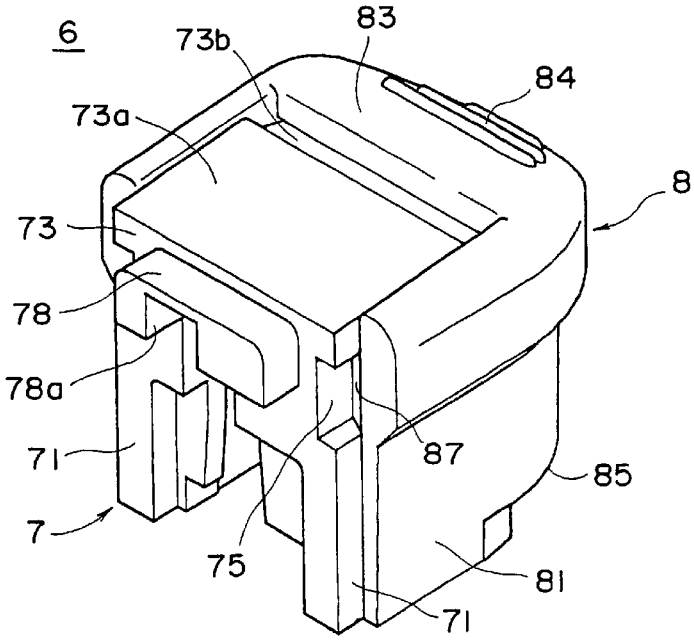
FIG. 2 is a perspective view of the depression means in the state shown in FIG. 1.

A piezoelectric gas lighter in accordance with a first embodiment of the present invention will be described with reference to FIGS. 1 to 8B, hereinbelow. In this specification, front and back (rear), and left and right are expressed with the left and the right as seen in FIG. 1 considered to be the front and the back.

In FIGS. 1 to 8B, the gas lighter 1 of the first embodiment comprises a lighter body 2 in which fuel gas is stored, a fuel supply means 3 including a nozzle 31 for discharging the fuel gas and a valve mechanism 32, an actuator lever 4 for opening and closing the valve mechanism 32, a spark ignition means 5 having a piezoelectric unit 51, and a depression means 6 which actuates the actuator lever 4 and the spark ignition means 5 to ignite the fuel gas discharged from the nozzle 31. The depression means 6 comprises a control cap 7, a stopper member 8 and an urging member 9. The stopper member 8 and the urging member 8 form a lock mechanism.

Though not shown in detail, the lighter body 2 comprises a rectangular reservoir body 21 which is formed by molding of synthetic resin, an upper lid 22 which is fixed to the upper end of the reservoir body 21 in an air-tight fashion to form a fuel reservoir inside the reservoir body 21, and an intermediate casing 23 which is fitted on the reservoir body 21.

The valve mechanism 32 of the fuel supply means 3, which controls the amount of fuel gas to be discharged through the nozzle 31, is mounted on the upper lid 22 of the lighter body 2. The nozzle 31 is provided with a nozzle tip at its upper end and projects upward at the center of the valve mechanism 32. The actuator lever 4 is L-shaped and a groove 41 formed in one end portion of the actuator lever 4 is in engagement with the nozzle 31.

The actuator lever 4 is provided with a pivot 42 at the bent portion thereof and is supported for rotation about the pivot 42 on the intermediate casing 23 of the lighter body 2 with an arm 43 extending obliquely downward. The nozzle 31 is lifted upward to open the valve mechanism 32 in response to rotation of the actuator lever 4, whereby the fuel gas is discharged through the tip of the nozzle 31.

The upper portion of the nozzle 31 is surrounded by a windshield cap 10. Reference numeral 33 denotes a flame regulator ring 33 for regulating the amount of the fuel gas to be discharged through the nozzle 31.

The control cap 7 is disposed on the intermediate casing 23 of the lighter body 2 on the side opposite to the nozzle 31. The control cap 7 can be depressed and is provided with a tubular portion. The piezoelectric unit 51 of the spark ignition means 5 is fitted in the tubular portion of the control cap 7. The spark ignition means 5 comprises a discharge electrode 52 which is connected to the piezoelectric unit 51 and is disposed on the upper portion of the control cap 7. A high voltage generated by the piezoelectric unit 51 is applied between the discharge electrode 51 and the nozzle 31 (nozzle tip) and a spark for igniting the fuel gas is generated.

Figure 4:
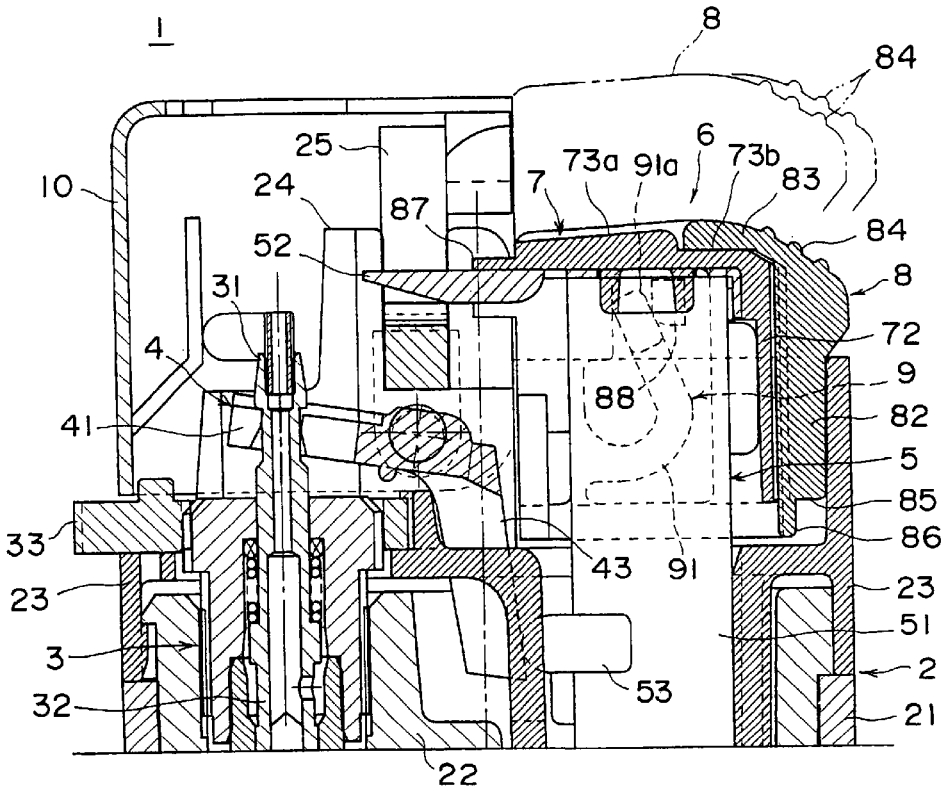
FIG. 4 is a fragmentary cross-sectional view of the gas lighter shown in FIG. 1 in an ignited state.

The upper half of the piezoelectric unit 51 is moved downward in response to depression of the control cap 7, and a lever pusher 53 which pushes the arm 43 of the actuator lever 4 to rotate the actuator lever 4 is provided on the upper half of the piezoelectric unit 51. With this arrangement, the lever pusher 53 rotates the actuator lever 4 to open the valve mechanism 32 so that the fuel gas is discharged through the nozzle 31 in response to depression of the control cap 7, and when the control cap 7 is further depressed, the piezoelectric unit 51 is actuated to generate a spark (FIG. 4).

The structure of the depression means 6 and the lock mechanism for the depression means 6 will be described, hereinbelow. The depression means 6 comprises the control cap 7 which holds the piezoelectric unit 51 and the stopper member 8 mounted on the control cap 7 to be movable between a locking position and a releasing position. The control cap 7 and the stopper member 8 are separately formed by plastic molding and the urging member 9 which urges the stopper member 9 to the locking position is formed integrally with the control cap 7.

Figure 3:
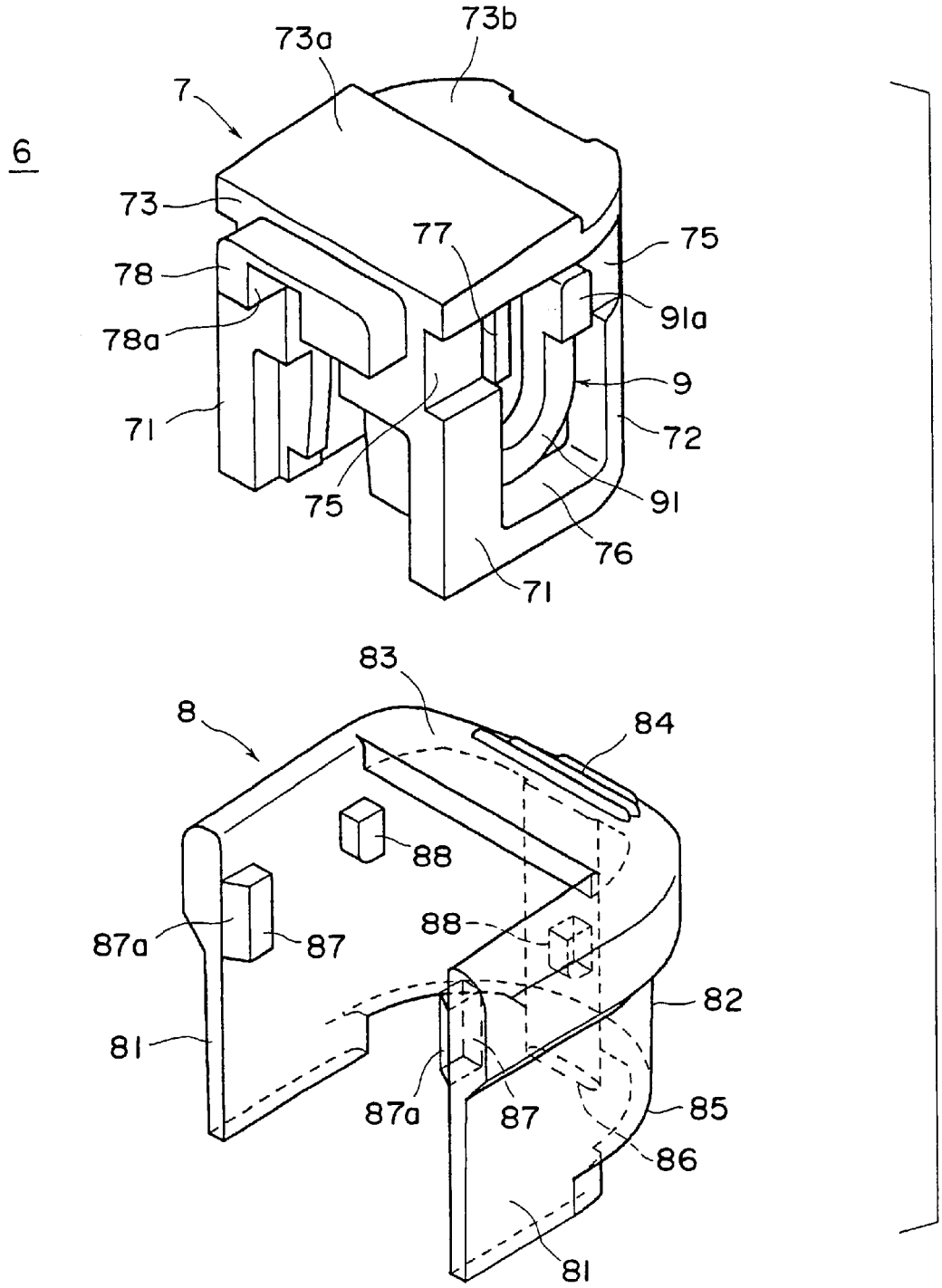
FIG. 3 is an exploded perspective view of the depression means in the state shown in FIG. 2.

As shown in FIG. 3, the control cap 7 is provided with the aforesaid tubular portion into which the upper end portion of the piezoelectric unit 51 is inserted. The tubular portion is formed by side walls 71 and the rear wall 72, and an upper wall 73 is formed above the tubular portion. A front portion of the top surface of the upper wall 73 forms a depressing portion 73*a* exposed upward. An engagement projection 74 (FIG. 1) extends downward from the lower surface of the upper wall 73 to be engaged with the upper end portion of the piezoelectric unit 51. A sliding groove 75 is formed in the outer surface of each side wall 71 to extend back and forth. A substantially square opening 76 is connected to the sliding groove 75 from below at the center of the sliding grove 75. A hook portion 77 is formed on the rear end of the portion of the sliding groove 75 on the front side of the opening 76 to project into the sliding groove 75.

A resilient piece 91 (as the urging member 9) is provided in each of the opening 76 of the control cap 7. The resilient piece 91 is formed integrally with the control cap 7 with its lower end portion connected to the front side wall of the opening 76. The resilient piece 91 extends rearward from its lower end portion and is bent upward so that its upper end portion 91*a* is positioned in the sliding groove 75. When the upper end portions 91*a* of the resilient pieces 91 are resiliently deformed back and forth, the stopper member 8 is urged. The upper end portions 91*a* of the resilient pieces 91 are also resiliently deformable inward.

A projecting portion 78 is provided in front of the depressing portion 73*a* slightly below the depressing portion 73*a*. The projecting portion 78 is inserted into the windshield cap 10 to prevent the control cap 7 from being drawn out upward. The projecting portion 78 is provided with a cutaway portion 78*a* on the lower surface thereof. The aforesaid discharge electrode 52 is disposed in the cutaway portion 78*a*. A recess 73*b* is formed on the rear side of the depressing portion 73*a*, and the side walls 71 and the rear wall 72 are inside of the peripheral surface of the intermediate casing 23 of the lighter body 2.

The stopper member 8 is U-shaped in plan and comprises a pair of sliding portions (opposite side walls) 81 and a rear wall 82. An upper wall 83 is formed on a rear portion of the upper surfaces of the sliding portions 81. The front portion of the upper wall 83 is cut away in a shape conforming to the depressing portion 73*a* of the control cap 7. A releasing operation portion 84 in the form of a stepped surface is formed from a rear portion of the upper wall 83 to an upper end portion of the rear wall 82, and an engagement shoulder 85 is formed from a lower end portion of the rear wall 82 to rear end portions of the sliding portions 81. An engagement projection 86 extends downward from the lower end of the rear wall 82 at the center thereof. The lower halves of the sliding portions 81 and the rear wall 82 are shaped to be able to be inserted into the upper portion of the intermediate casing 23 of the lighter body 2, and their upper halves are expanded outward so that when the stopper member 8 is moved back to the locking position, the engagement shoulder 85 is brought into engagement with the rear upper end portion of the intermediate casing 23. Front and rear projections 87 and 88 are formed on the inner surface of an upper portion of each of the sliding portions 81. The front end surface 87*a* of the front projection 87 is inclined.

The stopper member 8 is mounted on the control cap 7 by fitting the stopper member 8 on the control cap 7 from the rear side with the front and rear projections 87 and 88 on the sliding portions 81 received in the sliding groove 75 so that the sliding portions 81 are held on the control cap 7 to be slidable back and forth between the locking position and the releasing position and to be movable downward together with the control cap 7 and so that the sliding portions 81 and the rear wall 82 surround the side surfaces and the rear surface of the control cap 7.

When the front projection 87 is inserted into the sliding groove 75 from the rear side during mounting the stopper member 8 on the control cap 7, the front projection 87 is caused to pass by the resilient piece 91 by deforming inward the resilient piece 91 by virtue of the inclined front end surface 87*a* of the front projection 87 and to pass by the hook portions 77 by deforming outward the sliding portions 81 at the opening 76, and then is brought into engagement with the front portion of the sliding groove 75. Thus the stopper member 8 is mounted on the control cap 7 to be movable back and forth relative to the control cap 7. The rearmost position of the stopper member 8 relative to the control cap 7 is defined by abutment of the rear surfaces of the front projections 87 against the hook portions 77. Further, when the front projections 87 is in abutment against the hook portions 77, the rear projections 88 are in abutment against the upper portions 91*a* of the resilient pieces 91 with the resilient pieces 91 slightly deformed forward, whereby the stopper member 8 is urged rearward toward the locking position under the resiliency of the resilient pieces 91.

The stopper member/control cap assembly thus formed is incorporated on the intermediate casing 23 of the lighter body 2 in the manner shown in FIG. 1, and then the windshield cap 10 is mounted.

A support column 24 is formed on each side of the intermediate casing 23 at an upper central portion thereof, and a partition plate 25 is held by the support columns 24 to separate the inside of the intermediate casing 23 into a nozzle side space and a piezoelectric unit side space.

Figure 6A:
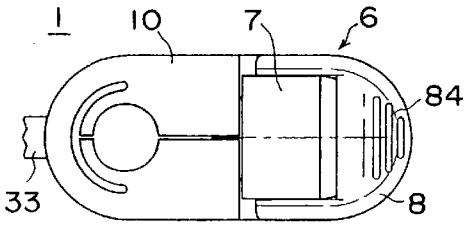
Figure 6B:
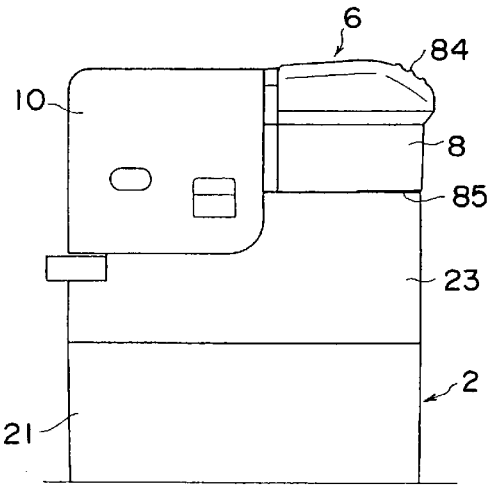
Figure 9A:
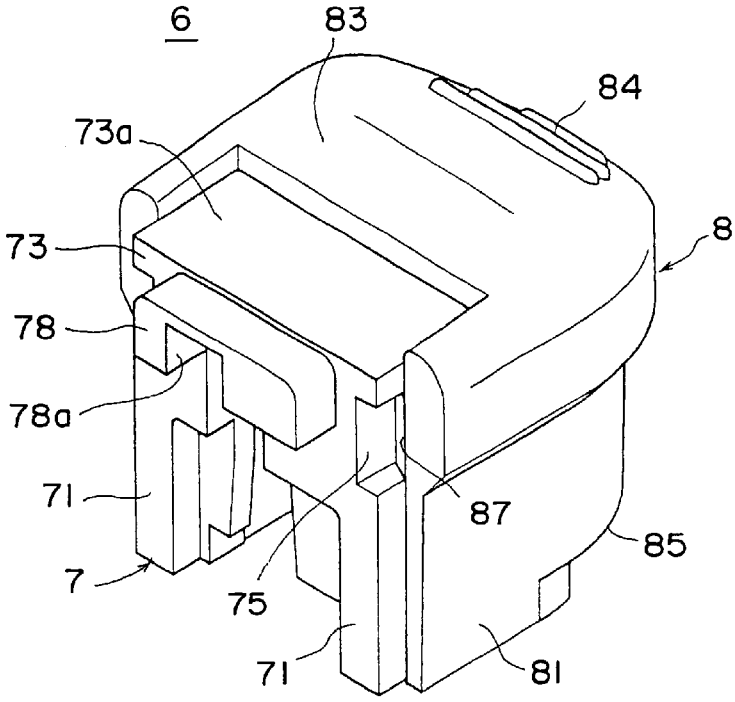
FIGS. 9A and 9B are perspective views respectively showing modifications of the depression means.
Figure 9B:
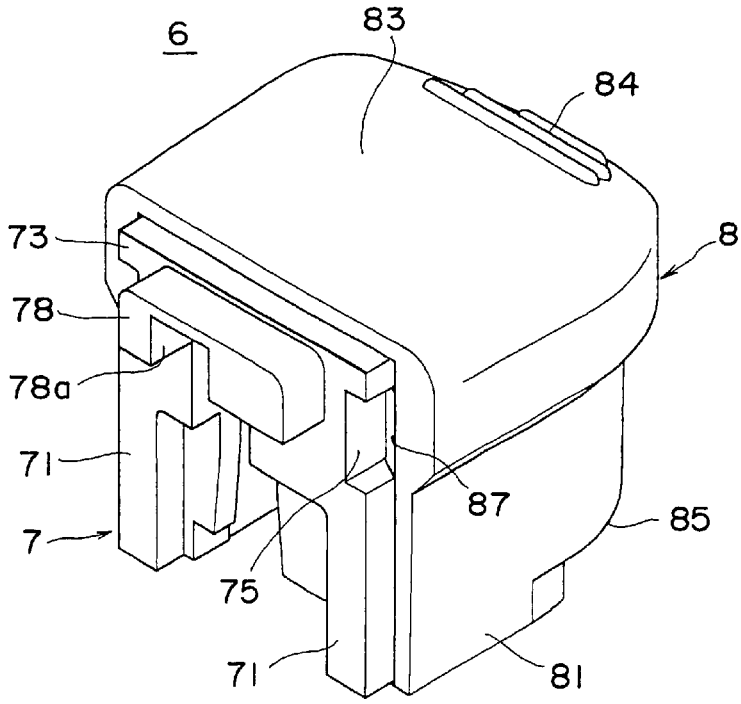
Figure 10A:
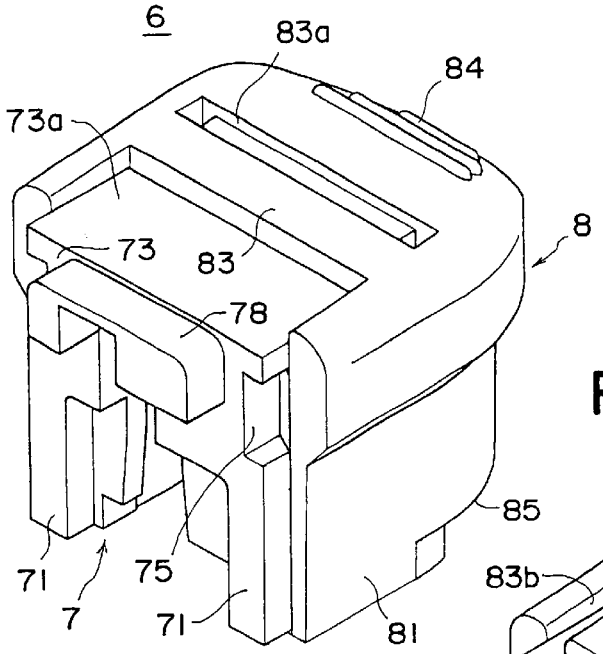
FIGS. 10A to 10C are perspective views respectively showing further modifications of the depression means.
Figure 10B:
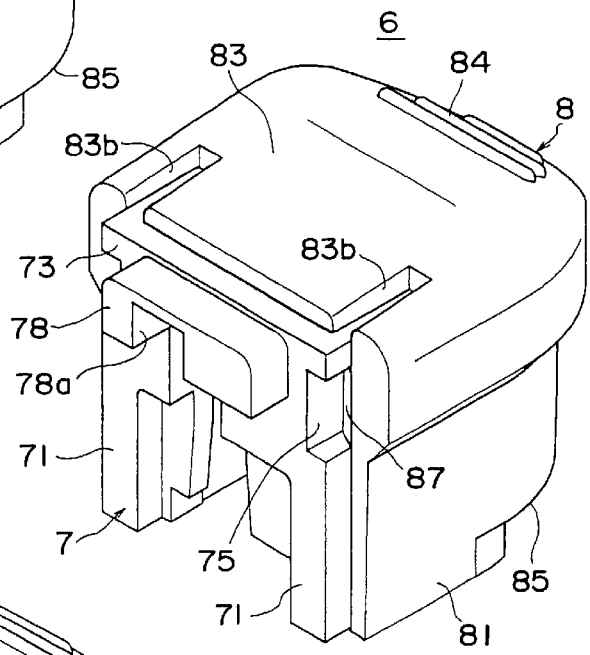
Figure 10C:
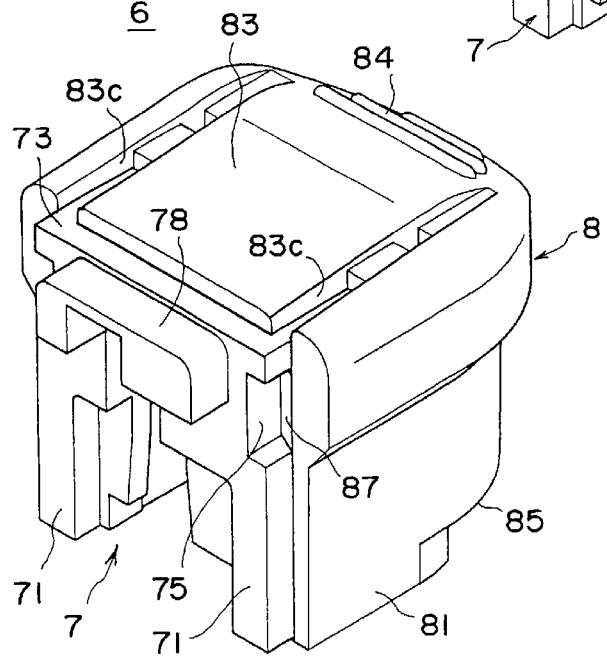

Operation of the gas lighter 1 of this embodiment will be described, hereinbelow. In the locked state of the gas lighter 1 shown in FIGS. 1 and 2, the control cap 7 and the stopper member 8 are held in their uppermost positions under the force of a spring built in the piezoelectric unit 51. Further, the stopper member 8 are held in the rearmost position under the resiliency of the resilient pieces 91 and a gap is formed between the rear wall 72 of the control cap 7 and the rear wall 82 of the stopper member 8. In this state, the engagement shoulder 85 of the stopper member 8 is in engagement with the upper edge of the rear portion of the intermediate casing 23 with the engagement projection 86 in abutment against the inner surface of the peripheral wall of the intermediate casing 23 and accordingly, the control cap 7 and the stopper member 8 cannot be depressed, that is, the gas lighter is locked. The appearance of the gas lighter 1 in the locked state is shown in FIGS. 6A and 6B.

Figure 7A:
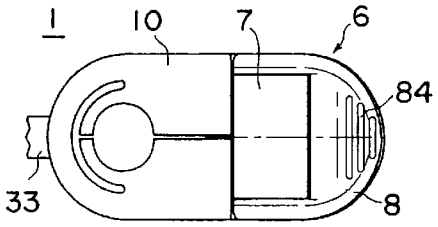
FIGS. 7A and 7B are a plan view and a side view, respectively, of the gas lighter shown in FIG. 1 when lock is released.
Figure 7B:
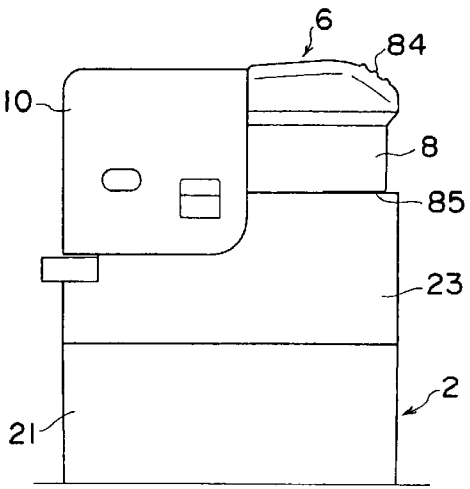

When the gas lighter 1 is to be used, the releasing operation portion 84 of the stopper member 8 is pushed forward to the releasing position and the stopper member 8 and the control cap 7 are depressed with the releasing operation portion 84 kept forward. That is, when the stopper member 8 is pushed forward toward the nozzle 31 overcoming the force of the resilient pieces 91, the resilient pieces 91 are further deformed in response to the forward movement of the rear projections 88 and the rear wall 72 of the control cap 7 is moved toward the rear wall 82 of the stopper member 8, whereby the engagement shoulder 85 is disengaged from the upper edge of the rear portion of the intermediate casing 23 to permit depression of the control cap 7 and the stopper member 8, that is, the gas lighter 1 is released. The appearance of the gas lighter 1 in the released state is shown in FIGS. 7A and 7B.

Figure 5:
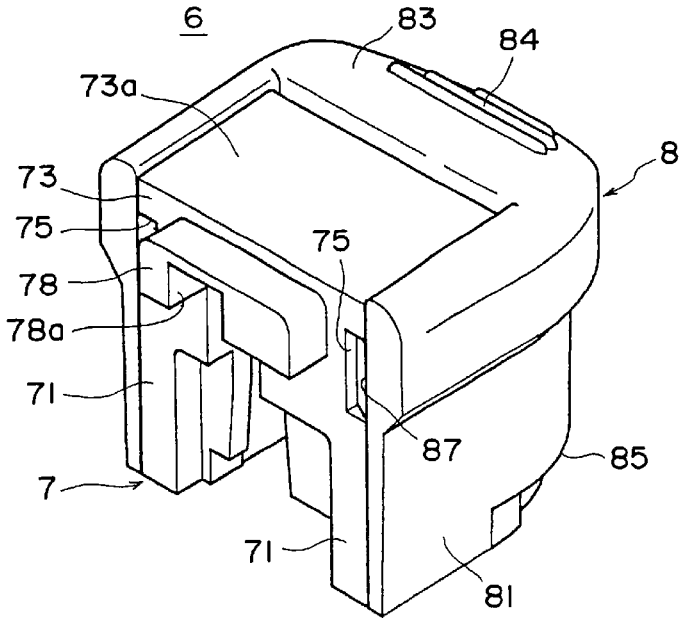
FIG. 5 is a perspective view of the depression means in the state shown in FIG. 4, FIGS. 6A and 6B are a plan view and a side view, respectively, of the gas lighter shown in FIG. 1 when it is not being used.
Figure 8A:
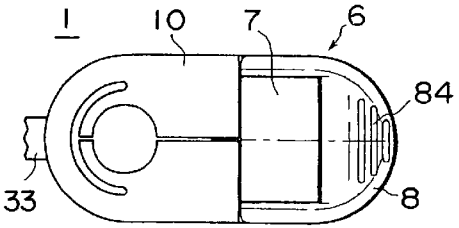
FIGS. 8A and 8B are a plan view and a side view, respectively, of the gas lighter shown in FIG. 1 when it is being used.
Figure 8B:
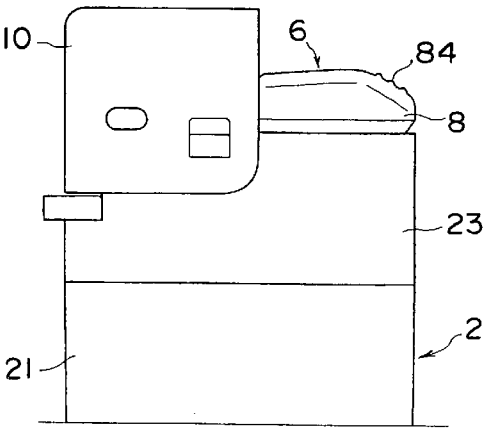

When the stopper member 8 and the control cap 7 are subsequently depressed, the lever pusher 53 is brought into abutment against the arm 43 of the actuator lever 4 to rotate the actuator lever 4, whereby the nozzle 31 of the fuel supply means 3 is lifted to open the valve mechanism 32 and the piezoelectric unit 51 is operated to ignite fuel gas discharged from the nozzle 31 as shown in FIGS. 4 and 5. The control cap 7 can be depressed by pushing downward the releasing operation portion 84 of the stopper member 8 instead of pushing downward the depressing portion 73*a* of the control cap 7 since the lower surface of the upper wall 83 of the stopper member 8 is in abutment against the recess 73*b* of the control cap 7. The appearance of the gas lighter 1 in the ignited state is shown in FIGS. 8A and 8B.

When the control cap 7 and the stopper member 8 are released, the control cap 7 is returned to the original position under the force of the spring built in the piezoelectric unit 51 and the like, and the valve mechanism 32 is closed, whereby the flame is quenched. At the same time, the stopper member 8 is returned to the locking position under the force of the resilient pieces 91 and the lighter 1 comes to be locked where depression of the control cap 7 is prevented.

FIGS. 9A and 9B and 10A to 10C show modifications of the depression means 6. In the modification shown in FIG. 9A, the upper wall 83 of the stopper member 8 is extended forward halfway to the front end of the sliding portions 81. In the modification shown in FIG. 9B, the upper wall 83 of the stopper member 8 is extended forward to the front end of the sliding portions 81 and covers the entire upper surface of the control cap 7. In the modification shown in FIG. 10A, the upper wall 83 of the stopper member 8 is extended forward halfway to the front end of the sliding portions 81 and a transverse slit 83*a* is formed in the upper wall 83. In the modification shown in FIG. 10B, the upper wall 83 of the stopper member 8 is extended forward to the front end of the sliding portions 81 and a pair of longitudinal slits 83*b* are formed from the front end of the sliding portions 81 halfway to the rear end of the same on opposite sides of the stopper member 8. In the modification shown in FIG. 10C, the upper wall 83 of the stopper member 8 is extended forward to the front end of the sliding portions 81 and a pair of longitudinal slits 83*b* are formed from the front end of the sliding portions 81 to the rear end of the same on opposite sides of the stopper member 8. Depending on the shape of the upper wall 83 of the stopper member 8, the shape of the upper surface of the upper wall 73 of the control cap 7 is changed so that the area of the depressing portion 73*a* exposed upward becomes as small as possible.

A piezoelectric gas lighter 100 in accordance with a first embodiment of the present invention will be described with reference to FIGS. 11 to 15, hereinbelow. The gas lighter 100 of this embodiment differs from that of the first embodiment mainly in that the depression means 6 is separated into a control cap 17, a stopper member 18 and an urging member 19, and accordingly, the elements analogous to those of the first embodiment are given the same reference numerals and will not be described here.

In this embodiment, the depression means 6 comprises three separate components formed by plastic molding, a control cap 17 which holds the piezoelectric unit 51, a stopper member 18 which is mounted on the control cap 17 to be movable between the locking position and the releasing position, and an urging member 19 which urges the stopper member 18 to the locking position.

The control cap 7 is provided with a tubular portion into which the upper end portion of the piezoelectric unit 51 is inserted. The tubular portion is formed by side walls 171 and the rear wall 172, and an upper wall 173 is formed above the tubular portion. A front portion of the top surface of the upper wall 173 forms a depressing portion 173*a* exposed upward. A sliding groove 175 is formed in the outer surface of each side wall 171 to extend back and forth. The part of the side wall 171 below the sliding groove 175 is substantially equal to the intermediate casing 23 of the lighter body 2 in width and can be fitted in the intermediate casing 23. An insertion groove 176 is formed in the part of the si de wall 171 below the sliding groove 175 to extend up and down and open at the upper and lower end. The upper wall 173 is smaller than the side walls 171 in width. A hook portion 177 projects into the sliding groove 175 at an intermediate portion thereof, and the rear end surface 177*a* of the hook portion 177 is inclined. A vertical groove 179 is formed in the rear wall 172 at the center thereof. An engagement portion 173*c* extends rearward from the rear end of the upper wall 173 at the center thereof. A recess 173*b* is formed on the upper wall 173 on the rear side of the depressing portion 173*a*. A projecting portion 178 is provided in front of the depressing portion 173*a* slightly below the depressing portion 173*a*. The projecting portion 178 is inserted into the windshield cap 10 to prevent the control cap 17 from being drawn out upward.

The urging member 19 comprises a pair of side frame portions 192 extending along the side walls 171 of the control cap 17 and a rear frame portion 193 which connects the rear ends of the side frame portions 192. A support portion 194 extends upward from the front end of each side frame portion 192. A resilient piece 191 is connected to the rear face of the support portion 194. The resilient piece 191 is connected to the rear face of the support portion 194 at its lower end and extends rearward curving upward to its upper end portion 191*a* which is higher than the upper end of the support portion 194 and is resiliently deformable back and forth. The rear top corner of the upper end of the upper end portion 191*a* is chamfered. A boss 195 extends upward from each of the side frame portions 192 near the rear end thereof, and the bosses 195 are inserted into the bottom of the control cap 17, whereby the urging member 19 is mounted on the control cap 17. At this time, the support portions 194 and the resilient pieces 191 of the urging member 19 are inserted into the insertion groove 176 of the control cap 17 from below so that the upper end portions 191*a* of the resilient pieces 191 project into the sliding grooves 175. The front portions of the upper ends of the support portions 194 project forward in engagement with the upper ends of the front ends portions of the insertion grooves 176.

Figure 11:
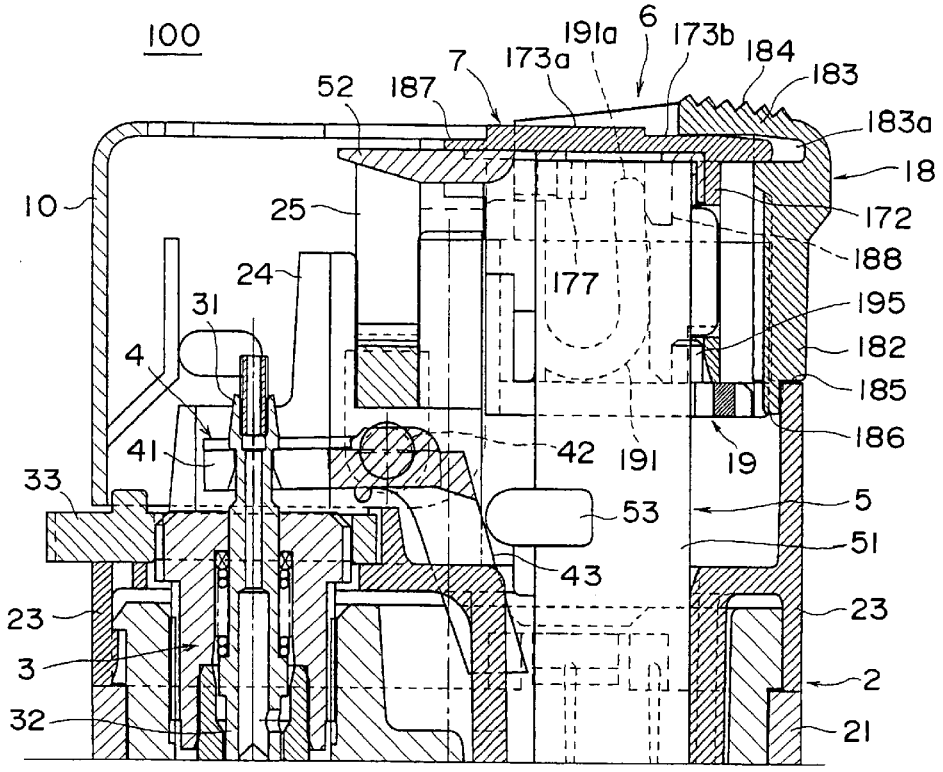
FIG. 11 is a fragmentary cross-sectional view of a piezoelectric gas lighter in accordance with a second embodiment of the present invention in a locked state.
Figure 12:
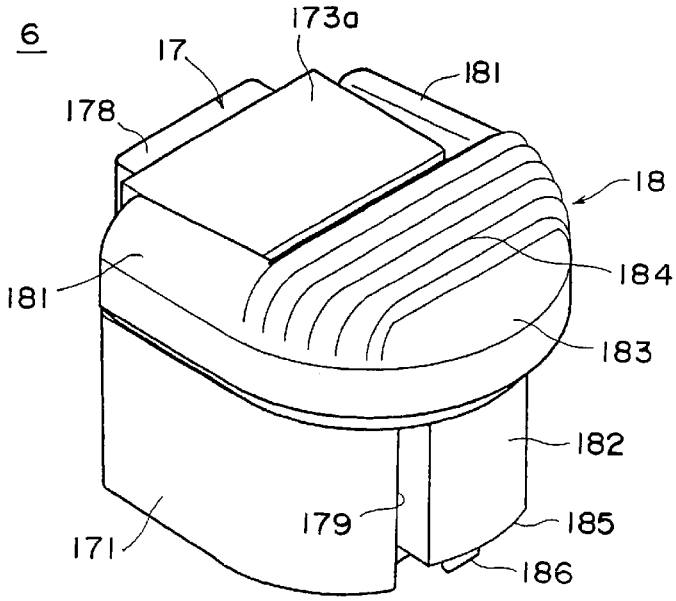
FIG. 12 is a perspective view of the depression means in the state shown in FIG. 11.

The stopper member 18 comprises a pair of sliding portions 181 extending along the opposite sides of the control cap 17 and an upper wall 183 formed to connect the rear portions of the sliding portions 181. The sliding portions 181 an the upper wall 183 are formed to cover the upper peripheral edge of the control cap 17. The front portion of the upper wall 183 is cut away in a shape conforming to the depressing portion 173*a* of the control cap 17. A rear wall 182 extends downward from the lower surface of the upper wall 183 at the center of the rear end thereof. The rear wall 182 is of such a width that permits the rear wall 182 to be inserted into the vertical groove 179 on the rear side of the control cap 17. The lower end face of the rear wall 182 forms an engagement shoulder 185 and an engagement projection 186 extends downward inward from the lower end face of the rear wall 182. A releasing operation portion 184 in the form of a stepped surface is formed on the upper surface of the upper wall 183. A recess 183*a* on which the engagement portion 173*c* extending from the rear end of the upper wall 173 slides is formed below the rear end portion of the lower surface of the upper wall 183 as shown in FIG. 11.

Front and rear projections 187 and 188 (FIG. 11) are formed on the inner surface of each of the sliding portions 181 on opposite sides of the position to be inserted into the sliding groove 175 of the control cap 17. The front end surface 187*a* of the front projection 187 is inclined and the front lower edge of the rear projection 188 is chamfered.

The stopper member 18 is mounted on the control cap 17 by fitting the stopper member 18 on the control cap 17 from the rear side with the front and rear projections 187 and 188 on the sliding portions 181 received in the sliding groove 175 so that the sliding portions 181 are held on the control cap 17 to be slidable back and forth between the locking position and the releasing position and to be movable downward together with the control cap 17 and so that the rear wall 182 is inserted into the vertical groove 179 of the control cap 17.

When the front projection 187 is inserted into the sliding groove 175 from the rear side during mounting the stopper member 18 on the control cap 17, the front projection 187 is caused to pass by the hook portion 77 by deforming outward the sliding portions 181 by virtue of the inclined front end face 187*a*, and then is brought into engagement with the front portion of the sliding groove 175. Thus the stopper member 18 is mounted on the control cap 17 to be movable back and forth relative to the control cap 17. The rearmost position of the stopper member 18 relative to the control cap 17 is defined by abutment of the rear surfaces of the front projections 187 against the hook portions 177. Further, the rear projection 188 is in the rear portion of the sliding groove 175.

Then the urging member 19 is mounted on the control cap 17 from below. That is, the support portions 194 and the resilient pieces 191 are inserted into the insertion grooves 176 of the control cap 17 from below so that the chamfered rear upper edges of the upper end portions 191*a* of the resilient pieces 191 are brought into abutment against the chamfered front lower edges of the rear projections 188 and the resilient pieces 191 are slightly deformed forward and so that the front portions of the upper ends of the support portions 194 are brought into engagement with the upper front ends of the insertion grooves 176 and the bosses 195 are fitted in the bottom of the control cap 17. The stopper member 18 is urged rearward toward the locking position under the resiliency of the resilient pieces 191 with the front projections 187 in abutment against the hook portions 177.

The control cap 17 mounted with the stopper member 18 and the urging member 19 is incorporated on the intermediate casing 23 of the lighter body 2 in the manner shown in FIG. 11, and then the windshield cap 10 is mounted.

Operation of the gas lighter 100 of this embodiment will be described, hereinbelow. In the locked state of the gas lighter 1 shown in FIGS. 11 and 12, the control cap 17 and the stopper member 18 are held in their uppermost positions under the force of a spring built in the piezoelectric unit 51. Further, the stopper member 18 are held in the rearmost position under the resiliency of the resilient pieces 191. In this state, the engagement shoulder 185 of the stopper member 18 is in engagement with the upper edge of the rear portion of the intermediate casing 23 with the engagement projection 186 in abutment against the inner surface of the peripheral wall of the intermediate casing 23 and accordingly, the control cap 17 and the stopper member 18 cannot be depressed, that is, the gas lighter is locked.

When the gas lighter 100 is to be used, the releasing operation portion 184 of the stopper member 18 is pushed forward to the releasing position and the stopper member 18 and the control cap 17 are depressed with the releasing operation portion 184 kept forward. That is, when the stopper member 18 is pushed forward toward the nozzle 31, the resilient pieces 191 are further deformed in response to the forward movement of the rear projections 188 and the engagement shoulder 185 is disengaged from the upper edge of the rear portion of the intermediate casing 23 to permit depression of the control cap 17 and the stopper member 18, that is, the gas lighter 1 is released.

Figure 14:
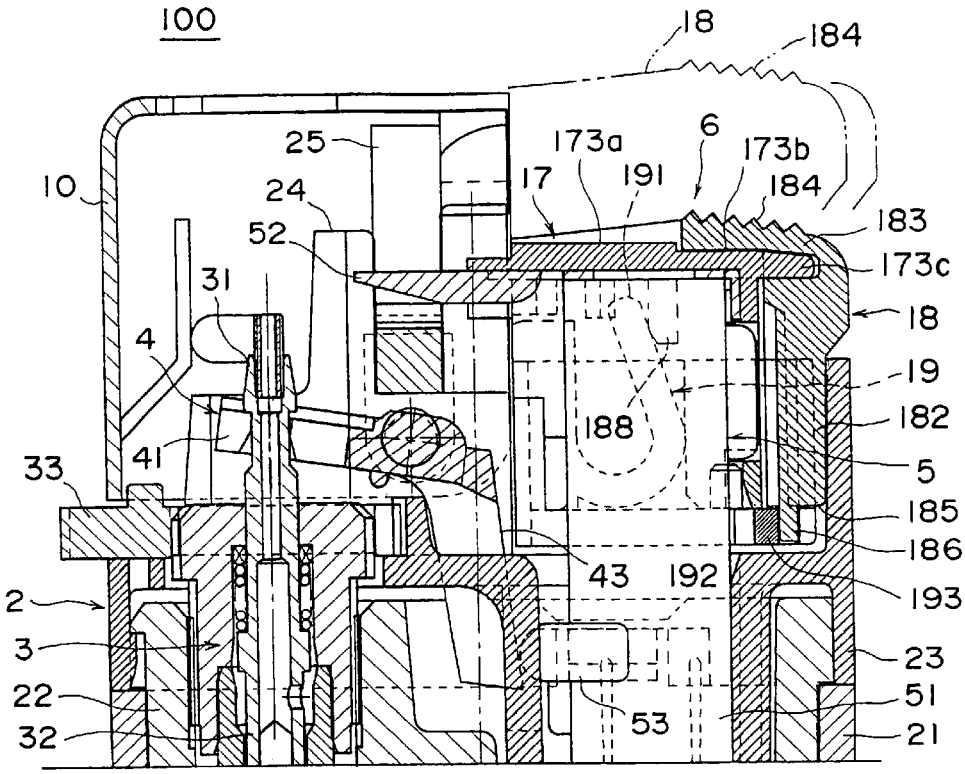
FIG. 14 is a fragmentary cross-sectional view of the as lighter shown in FIG. 11 in an ignited state.
Figure 15:
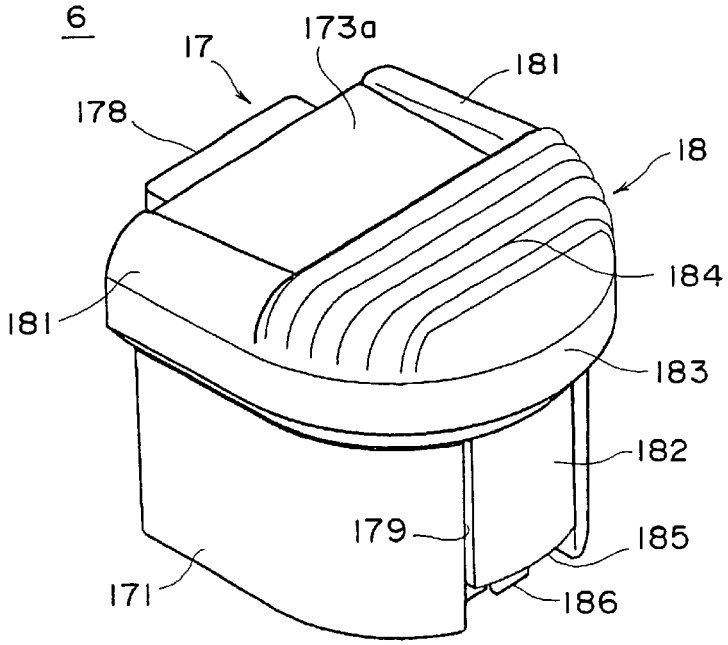
FIG. 15 is a perspective view of the depression means in the state shown in FIG. 13.

When the stopper member 18 and the control cap 17 are subsequently depressed, the lever pusher 53 is brought into abutment against the arm 43 of the actuator lever 4 to rotate the actuator lever 4, whereby the nozzle 31 of the fuel supply means 3 is lifted to open the valve mechanism 32 and the piezoelectric unit 51 is operated to ignite fuel gas discharged from the nozzle 31 as shown in FIGS. 14 and 15.

When the control cap 17 and the stopper member 18 are released, the control cap 17 is returned to the original position under the force of the spring built in the piezoelectric unit 51 and the like, and the valve mechanism 32 is closed, whereby the flame is quenched. At the same time, the stopper member 18 is returned to the locking position under the force of the resilient pieces 191 and the lighter 100 comes to be locked where depression of the control cap 17 is prevented.

Also in this embodiment, the upper wall 183 of the stopper member 18 may be modified as described above in conjunction with FIGS. 9A to 10C.

Figure 13:
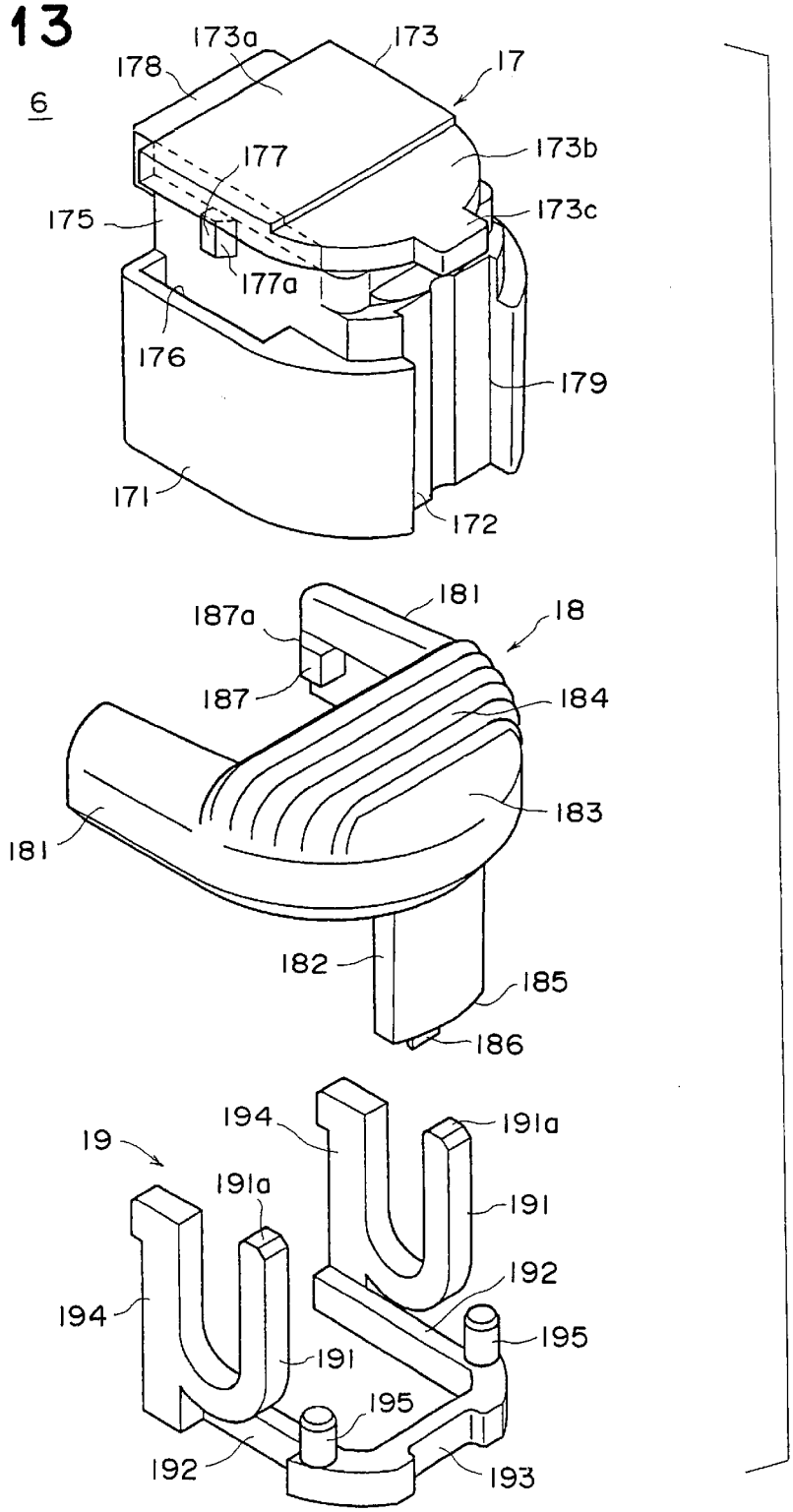
FIG. 13 is an exploded perspective view of the depression means in the state shown in FIG. 12.
Figure 16:
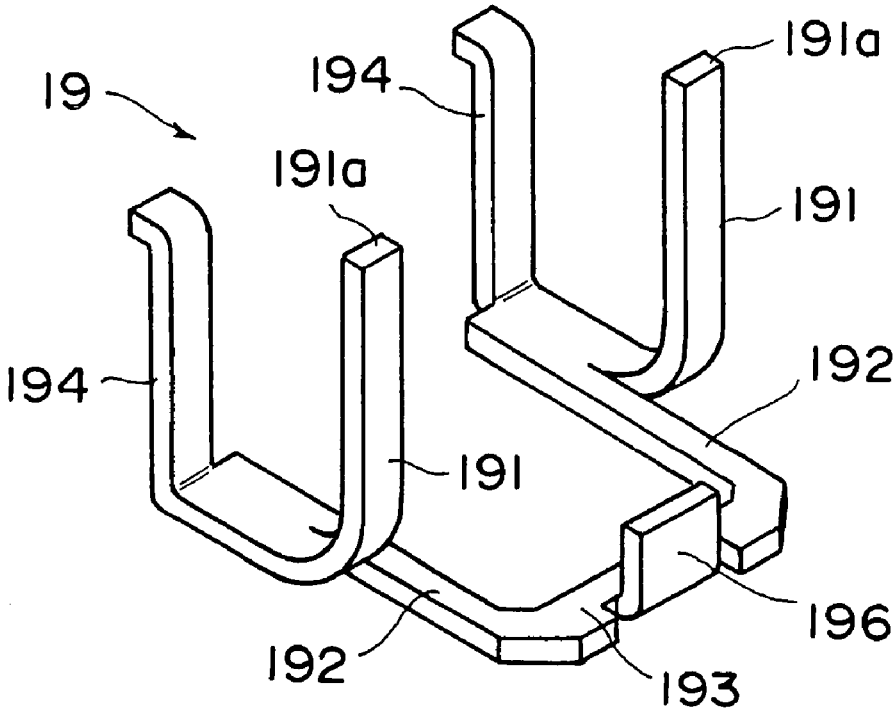
FIG. 16 is a modification of the urging member in the state shown in FIG. 13.

FIG. 16 shows a modification of the urging member 19 shown in FIG. 13. The modification is formed by stamping press of a metal plate (metal spring). The basic shape of the urging member shown in FIG. 16 is the same as that shown in FIG. 13, and the analogous parts are given the same reference numerals.

That is, the urging member 19 formed of a metal plate comprises a pair of side frame portions 192 which extends back and forth at a lower portion of the urging member 19 and a rear frame portion 193 which connects the rear ends of the side frame portions 192. A support portion 194 extends upward from the front end of each side frame portion 192. A resilient piece 191 is erected upward from an intermediate portion of each side frame portion 192. The resilient piece 191 is connected to the side frame portion 192 at its lower end and extends upward to its upper end portion 191*a* which is higher than the upper end of the support portion 194 and is resiliently deformable back and forth. A projection 195 extends upward from the middle of the rear frame portion 193, and the projection 195 is inserted into the bottom of the control cap 17, whereby the urging member 19 is mounted on the control cap 17. The urging member 19 shown in FIG. 16 is mounted on the control cap 17 in the similar manner to that shown in FIG. 13. The resilient pieces 191 are resiliently deformed by the rear projections 188 of the stopper member 18 and the stopper member 18 is urged to the locking position under the force generated by the resilient deformation of the resilient pieces 191.

In addition, all of the contents of Japanese Patent Application No. 11(1999)-323770 are incorporated into this specification by reference.

What is claimed is:

1. A piezoelectric gas lighter comprising a lighter body in which fuel gas is stored, a fuel supply means which supplies the fuel gas in the lighter body to a nozzle through a valve mechanism, an actuator lever for opening and closing the valve mechanism, a spark ignition means which ignites the fuel gas discharged from the nozzle, and a depression means which actuates the actuator lever and the spark ignition means to open the valve mechanism and ignite the fuel gas discharged from the nozzle in response to depression of the depression means, wherein the improvement comprises that the depression means comprises a control cap operatively connected to a piezoelectric unit, a stopper member which is movable between a locking position where a part of the stopper member is engaged with the lighter body to disable the control cap from being depressed and a releasing position where the stopper member is released from the lighter body to permit depression of the control cap and an urging member which urges the stopper member to the locking position, the stopper member is provided with a pair of sliding portions extending back and forth on opposite sides of the control cap and the sliding portions are slidably supported by the control cap so that the stopper member is movable downward together with the control cap and movable between the locking position and the releasing position, and the urging member comprises a pair or resilient pieces provided on opposite sides of the control cap so that they are engaged with the sliding portions of the stopper member to urge the stopper member to the locking position and the stopper member is moved from the locking position to the releasing position by urging the stopper member toward the control cap in which the urging member is formed of a pair of resilient pieces formed integrally with the control cap.

2. A piezoelectric gas lighter comprising a lighter body in which fuel gas is stored, a fuel supply means which supplies the fuel gas in the lighter body to a nozzle through a valve mechanism, an actuator lever for opening and closing the valve mechanism, a spark ignition means which ignites the fuel gas discharged from the nozzle, and a depression means which actuates the actuator lever and the spark ignition means to open the valve mechanism and ignite the fuel gas discharged from the nozzle in response to depression of the depression means, wherein the improvement comprises that the depression means comprises a control cap operatively connected to a piezoelectric unit, a stopper member which is movable between a locking position where a part of the stopper member is engaged with the lighter body to disable the control cap from being depressed and a releasing position where the stopper member is released from the lighter body to permit depression of the control cap and an urging member which urges the stopper member to the locking position, the stopper member is provided with an upper surface portion adjacent to an upper surface of the control cap and with a pair of sliding portions extending back and forth on opposite sides of the control cap and the sliding portions are slidably supported by the control cap so that the stopper member is movable downward together with the control cap and movable between the locking position and the releasing position, and the urging member comprises a pair of resilient pieces provided on opposite sides of the control cap so that they are engaged with the sliding portions of the stopper member to urge the stopper member to the locking position and the stopper member is moved from the locking position to the releasing position by urging the stopper member toward the control cap, wherein the control cap is provided with a hook portion which is engaged with a projection, which projects inward from the sliding portions of the stopper member, to limit the movement of the stopper member to the locking position.

3. A piezoelectric gas lighter comprising a lighter body in which fuel gas is stored, a fuel supply means which supplies the fuel gas in the lighter body to a nozzle through a valve mechanism, an actuator lever for opening and closing the valve mechanism, a spark ignition means which ignites the fuel gas discharged from the nozzle, and a depression means which actuates the actuator lever and the spark ignition means to open the valve mechanism and ignite the fuel gas discharged from the nozzle in response to depression of the depression means, wherein the improvement comprises that the depression means comprises:

a control cap operatively connected to a piezoelectric unit, wherein the control cap has a pair of sliding grooves formed along its side walls;

a stopper member having projections that are slidably supported in the sliding grooves, wherein the stopper member is slidable between a locking position where a part of the stopper member is engaged with the lighter body to disable the control cap from being depressed and a releasing position where the part of the stopper member is conversely disengaged from the lighter body to enable depression of the control cap; and an urging member comprising a pair of pieces disposed on opposite sides of the control cap so that they are engaged with the projections of the stopper member to urge the stopper member to the locking position, and wherein sliding the projections along the surfaces of the sliding grooves away from the locking position pushes the urging member to allow the stopper ember to slide from the locking position to the releasing position.

4. A piezoelectric gas lighter of claim 3 wherein the urging member comprises resilient material.

5. A piezoelectric gas lighter of claim 3 wherein the urging member comprises:

a pair of side frame portions whose rear ends are connected by a rear frame portion;

a pair of support portions, wherein each support portion extends upward from a front end of a respective side frame portion;

a pair of resilient pieces, wherein each resilient piece is connected to a respective side frame portion, and wherein each resilient piece extends upward substantially parallel to the support portions.

6. The piezoelectric gas lighter of claim 3 wherein the urging member comprises:

a pair of side frame portions whose rear ends are connected by a rear frame portion;

a pair of support portions, wherein each support portion extends upward from a front end of a respective side frame portion;

a pair of resilient pieces, wherein each resilient piece is connected to a respective side frame portion, and wherein each resilient piece extends upward substantially parallel to the support portions.

* * * * *